US007506529B2

(12) United States Patent
Bauer et al.

(10) Patent No.: US 7,506,529 B2
(45) Date of Patent: Mar. 24, 2009

(54) METHOD FOR PRODUCING A CAN BASE AND A LEVER RING

(75) Inventors: Sven Bauer, Steisslingen (DE); Reinhart Geisler, Gottmadingen (DE)

(73) Assignee: Alcan Technology & Management Ltd., Neuhausen am Rheinfall (CH)

( * ) Notice: Subject to any disclaimer, the term of this patent is extended or adjusted under 35 U.S.C. 154(b) by 0 days.

(21) Appl. No.: 10/516,116

(22) PCT Filed: Jun. 7, 2003

(86) PCT No.: PCT/EP03/06003

§ 371 (c)(1),
(2), (4) Date: Nov. 29, 2004

(87) PCT Pub. No.: WO2004/002649

PCT Pub. Date: Jan. 8, 2004

(65) Prior Publication Data

US 2005/0166658 A1 Aug. 4, 2005

(30) Foreign Application Priority Data

Jun. 27, 2002 (EP) ..... 02405547

(51) Int. Cl.
*B21D 51/00* (2006.01)

(52) U.S. Cl. ..... 72/379.4; 72/715; 72/348; 413/8

(58) Field of Classification Search ..... 72/379.4, 72/347, 348, 715, 341; 413/1, 2, 8, 12, 69, 413/56, 76

See application file for complete search history.

(56) References Cited

U.S. PATENT DOCUMENTS

| | | | | | |
|---|---|---|---|---|---|
| 3,428,010 | A | * | 2/1969 | Frankenberg | 413/7 |
| 4,681,237 | A | * | 7/1987 | Hartman | 220/606 |
| 4,742,949 | A | * | 5/1988 | Glerum et al. | 228/156 |
| 5,287,713 | A | * | 2/1994 | Mine et al. | 72/43 |
| 5,758,475 | A | * | 6/1998 | Breuer et al. | 53/453 |

FOREIGN PATENT DOCUMENTS

| | | | |
|---|---|---|---|
| DE | 4332306 | | 3/1995 |
| EP | 0 921 878 | * | 6/1999 |
| EP | 0921878 B1 | * | 6/1999 |
| EP | 1153840 A1 | | 11/2001 |
| EP | 1153840 B1 | | 11/2001 |

* cited by examiner

*Primary Examiner*—Dana Ross
*Assistant Examiner*—Debra M Sullivan
(74) *Attorney, Agent, or Firm*—Fisher, Christen & Sabol

(57) ABSTRACT

A method for producing a cylindrical, seamless can body (20) made of metal with associated can top end. The can top end includes a top end ring, that can be connected to the opening edge (21) of the can body (20) and borders a removal opening (30) and a sealing diaphragm (31) arranged on the top end ring and covering the removal opening. A cylindrical, seamless can body blank (10) is produced. Following trimming of the opening edge (11) of the can body blank (10), a cylindrical ring (18) is separated therefrom. The height of the can body blank (10) is preset in such a way that the can body (20) is formed during separation of the cylindrical ring (18). The scrap portion can also be reduced by the method during production of can bodies and top end rings.

8 Claims, 1 Drawing Sheet

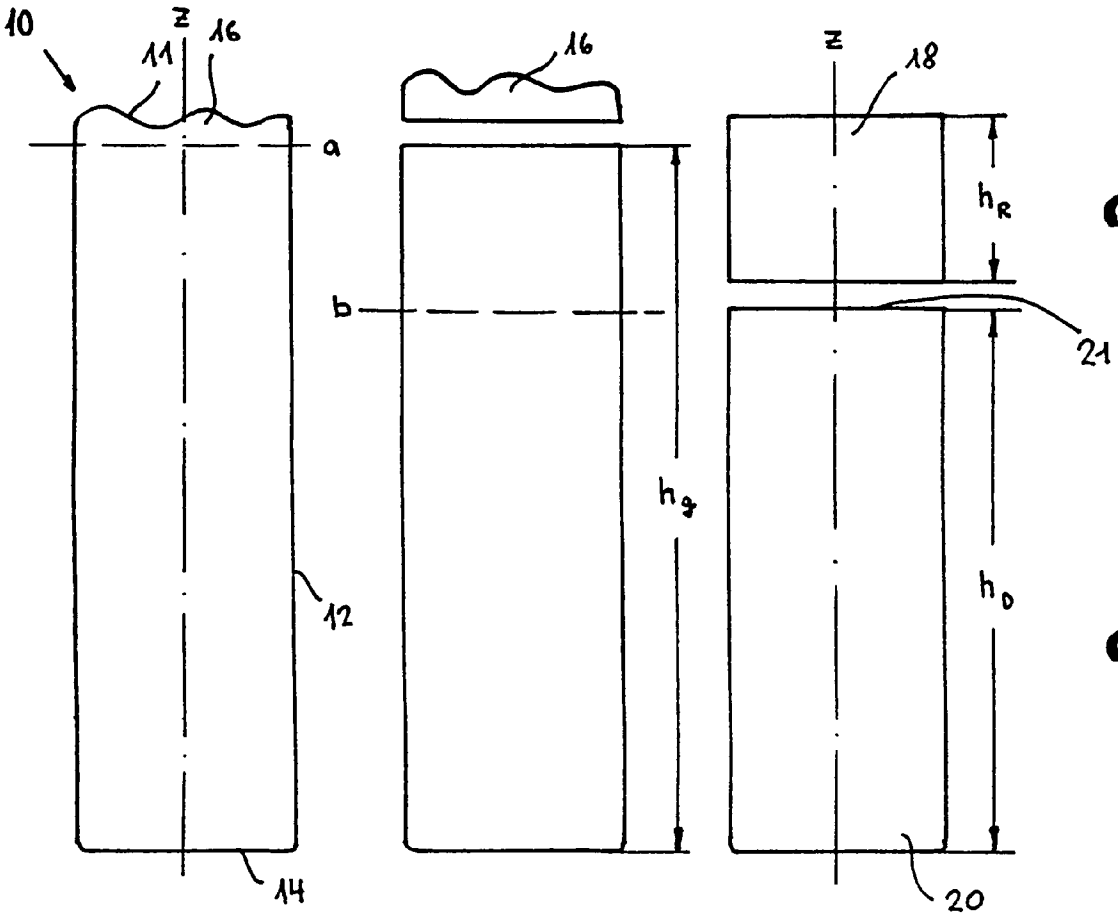
Fig. 1
Fig. 2
Fig. 3
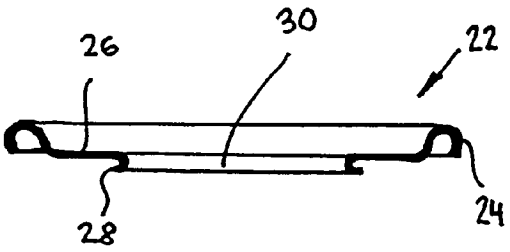
Fig. 4
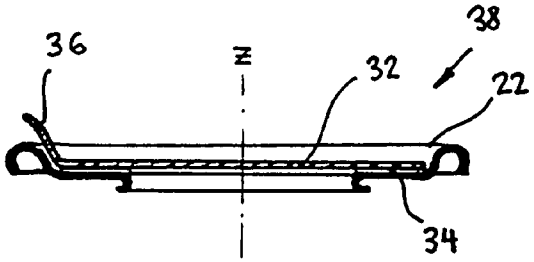
Fig. 5

METHOD FOR PRODUCING A CAN BASE AND A LEVER RING

This is a 371 national stage application of PCT/EP2003/006003, filed on Jun. 7, 2003, that has benefit of European Patent Application No. 02405547.7, filed on Jun. 27, 2002.

The invention relates to a method for producing a cylindrical, seamless can body and a top end ring made of metal, wherein the top end ring which can be connected to the opening edge of a can body borders a removal opening and a sealing diaphragm covering the removal opening can be attached to the top end ring to form a can top end, in which method a cylindrical ring is shaped into a top end ring.

In known can top ends of the type mentioned at the outset comprising a top end ring and a sealing diaphragm arranged thereon, the removal opening extends up to the vicinity of the flange, so, after removal of the sealing diaphragm only a narrow ring face adjoining radially inwardly from the flange remains. After removal of the sealing diaphragm, which in most cases is designed as a tear foil, after peeling of the diaphragm a relatively large container opening is created, similar to a completely tear-open cover, so the filling product is easily accessible. A further advantage of this cover system is that the filling product can be sterilised.

In a method known from EP-A-1 153 840 for producing a top end ring for a can top end with a sealing diaphragm, initially a flat sheet metal part is shaped into a cylindrical tube. The axially extending edges of the tube are pressed together and welded to one another and this takes place by means of a laser beam and leads to the formation of a butt joint weld. The tube is then divided into tube portions or cylindrical rings of equal length. Each cylindrical ring is shaped into a top end ring with a flange for fastening on a can body and into an annular support face for the later fastening of the sealing diaphragm. It is also known from DE-A-43 32 306, instead of the sheet metal part welded and shaped into a cylindrical tube, to form by multi-stage deep-drawing a can which is as tall as possible with a cylindrical wall and then to divide the cylindrical wall into a plurality of cylindrical rings. The remaining base part of the can is thrown away as scrap.

The two above-mentioned methods for producing a top end ring starting from a cylindrical ring have the advantage of a substantially reduced scrap portion compared to conventional top end ring production, in which initially a sheet metal disc is shaped and then the removal opening is punched to form the top end ring.

The object of the invention is to provide a method of the type mentioned at the outset by which the scrap portion during production of can bodies and top end rings can be further reduced.

The object is achieved by the production of a cylindrical seamless can body blank and the separation of the cylindrical ring therefrom, the height of the can body blank being preset in such a way that the can body is formed either during separation of the cylindrical ring or following separation of the cylindrical ring and a further shaping.

The concept on which the method is based, of providing a cylindrical ring to produce a top end ring in the same operation during production of a can body, leads to the desired minimisation of the scrap portion which is limited to the trimming of the opening edge of the can body blank produced in this way and which is not larger than the scrap portion occurring in the production of seamless can bodies. The method according to the invention can be integrated into an existing production line with low investment outlay. In the simplest case, only the arrangement of a second cutter or another cutting or separating device is required spaced from the existing trimming device.

The cylindrical ring separated from the can body blank is preferably shaped into a top end ring comprising a flange for fixing on the opening edge of a can body and comprising an annular face lying in the top end plane for fastening the sealing diaphragm.

As the production of the can body blank takes place in a plurality of drawing steps, it may prove advantageous to already separate the cylindrical ring from the can body blank after an intermediate drawing step, in other words prior to the complete forming of the can body blank. The cylindrical ring in this case has a greater material thickness and a greater diameter than the final formed can body.

However, the cylindrical ring is preferably separated from the can body blank only after the complete forming of the can body blank and after trimming the opening edge of the can body blank.

Any metals known for can production, such as aluminium, steel or tin sheet are suitable as the metal for carrying out the method according to the invention. The metals may also be lacquered or be shaped with a plastic coating made of, for example, polypropylene.

The top end ring does not necessarily have to be used together with the can body produced by this method. It can be used in single or two-part can bodies made of different metals or else in can bodies made of other materials than metal, for example made of plastics material or coated cardboard materials.

A particularly preferred method relates to the production of a cylindrical, seamless can body made of metal with an associated can top end, the can top end comprising a top end ring which can be connected to the opening edge of the can body and bordering a removal opening, and a sealing diaphragm arranged on the top end ring and covering the removal opening, in which method a cylindrical ring is shaped into a top end ring. The method is distinguished in that a cylindrical, seamless can body blank is produced and the cylindrical ring is separated therefrom following trimming of the opening edge of the can body blank, the height of the can body blank being preset in such a way that the can body is formed during separation of the cylindrical ring.

It is obvious that the cylindrical ring which is separated from the can body blank or the top end ring produced therefrom does not necessarily have to be used together with the can body produced from the same can body blank. Instead a separate further processing of the can body and the cylindrical rings and the later unordered bringing together of can bodies and top end rings produced from the cylindrical rings would be an expedient variation of the method.

Further advantages, features and details of the invention emerge from the following description of preferred embodiments and with reference to the drawings, in which:

FIG. 1 shows a lateral view of the can body blank with earing;

FIG. 2 shows a lateral view of the can body blank from FIG. 1 with separated ears;

FIG. 3 shows a lateral view of the can body blank from FIG. 2 with further separated cylindrical ring;

FIG. 4 shows a partial section through a top end ring produced from the cylindrical ring from FIG. 3;

FIG. 5 shows the partial section through the top end ring from FIG. 4 with sealed-on sealing diaphragm.

A can body blank 10 shown in FIG. 1 shows a cylindrical can body 12 which is closed on one side with an integral base 14 in the form of a cylindrical tube section. The can body blank 10 may, in known manner, be produced from a disc or round blank made of metal by one-stage or multi-stage deep drawing, drawing, ironing, extruding and by further forming methods. In these methods the base 14 integrally formed on the can body 12 is produced as the remainder of the metal disc used as a blank after the shaping thereof. To produce the metal discs as blanks for producing the all round can body blank 10, tin sheet, chromium-plated steel sheet or aluminium sheet can be used in known manner.

The above-described forming processes, as a result of the known earing, lead to an unevenly formed opening edge 11 of the hollow bodies produced in this way. This uneven edge or the ears 16 are removed as scrap by a first horizontal cut a with respect to the vertically extending can axis z.

According to FIGS. 2 and 3, after trimming the edge with a second horizontal cut b, a cylindrical ring 18 is separated from the can body blank 10. In this process the starting height of the can body blank 10 is selected such that after trimming and separation of the cylindrical ring 18, the remainder of the can body blank 10 corresponds to the desired can body 20, in other words the total of the height $h_D$ of the can body 20 and the height $h_R$ of the cylindrical ring 18 produces the total height $h_G$ of the can body blank 10 after trimming the edge of the can body blank 10 or removal of the ears 16.

The cylindrical ring 18 is shaped in known manner by a plurality of consecutive shaping operations to form the top end ring 22 shown in FIG. 4.

The top end ring 22 has a conventional flanged rim 24 of which the free end corresponds to the edge produced by the first horizontal cut a. The flange 24 passes into a horizontal annular face 26. The inner edge 28 of the annular face 26 bordering a removal aperture 30 is rolled in to eliminate the risk of injury and to increase the stiffness of the top end ring 22 comprising the cut edge which is directed radially outwards, the cut edge corresponding to the edge produced by the second horizontal cut b.

In FIG. 5, the top end ring of FIG. 4 is provided with a sealing diaphragm 32. The sealing diaphragm 32 rests on the annular face 26 and is connected thereto by an adhesive or sealing layer 34. A foil made of aluminium or of tin sheet which may optionally have a heat sealing coating serves as the material for the sealing diaphragm 32. The sealing diaphragm 32 may be provided with a ring-pull tab 36. In this case the seal between the sealing diaphragm 32 and annular face 26 is adjusted such that the sealing diaphragm can be removed from the annular face or the sealing edge by peeling. In an alternative embodiment, the sealing diaphragm 32 is non-separably connected to the top end ring 22. In this case the diaphragm is pierced for opening and removed from the top end ring along the inner edge of the annular face 26.

The top end ring 22 provided with the sealing diaphragm 32 is seamed as the can top end 38 on the opening edge 21 of the can body 20 after filling with the filling product.

The invention claimed is:

1. A method for producing a cylindrical, seamless can body (20), that is without any outward protruding portion on cylindrical side thereof, with a preset height and a top end ring (22) made of metal, wherein the top end ring (22) which can be connected to the opening edge of a can body borders a removal opening (30) and a sealing diaphragm (32) covering the removal opening (30) can be attached to the top end ring (22) to form a can top end (38), a base (14) is seamlessly integral with the cylindrical, seamless can body (20), the cylindrical, seamless can body (20) is without any inward protruding portion on cylindrical side thereof except in region where the base (14) and the cylindrical, seamless can body (20) seamlessly integrate, the method includes producing a cylindrical seamless can body blank (10), that is without any outward protruding portion on cylindrical side thereof, and that is without any inward protruding portion on cylindrical side thereof except in region where the base (14) and the cylindrical, seamless can body blank (10) seamlessly integrate, in a plurality of drawing steps, separating a cylindrical ring (18) therefrom, following separation of the cylindrical ring (18), further shaping the can body blank (10), that is without any outward protruding portion on cylindrical side thereof, and that is without any inward protruding portion on cylindrical side thereof except in region where the base (14) and the cylindrical, seamless can body blank (10) seamlessly integrate, in at least one further drawing step into the can body (20) with the preset height, and shaping the cylindrical ring (18) into the top end ring (22).

2. The method according to claim 1, wherein the cylindrical ring (18) is shaped into a top end ring (22) with a flange (24) for fixing on the opening edge of a can body and comprising an annular face (26) lying in the top end plane for fastening the sealing diaphragm (32).

3. The method according to claim 1, wherein the cylindrical ring (18) is separated from the can body blank (10) prior to the complete forming of the can body blank (10).

4. A method for producing a cylindrical, seamless can body (20), that is without any outward protruding portion on cylindrical side thereof, with a preset height and a top end ring (22) made of metal, wherein the top end ring (22) which can be connected to the opening edge of a can body borders a removal opening (30) and a sealing diaphragm (32) covering the removal opening (30) can be attached to the top end ring (22) to form a can top end (38), a base (14) is seamlessly integral with the cylindrical, seamless can body (20), the cylindrical, seamless can body (20) is without any inward protruding portion on cylindrical side thereof except in region where the base (14) and the cylindrical, seamless can body (20) seamlessly integrate, the method including producing a cylindrical seamless can body blank (10), that is without any outward protruding portion on cylindrical side thereof, and that is without any inward protruding portion except in region where the base (14) and the cylindrical, seamless can body blank (10) seamlessly integrate, in a plurality of drawing steps into the can body (20) with the preset height, trimming of the opening edge 11 of the can body blank (10), separating a cylindrical ring (18) from the can body blank (10), and shaping the cylindrical ring (18) into the top end ring (22).

5. A method for producing a cylindrical, seamless can body (20), that is without any outward protruding portion on cylindrical side thereof, made of metal with associated can top end (38), wherein the can top end (38) comprises a top end ring (22) which can be connected to the opening edge (21) of the can body (20) and bordering a removal opening (30), and a sealing diaphragm (32) arranged on the top end ring (22) and covering the removal opening (30), a base (14) is seamlessly integral with the cylindrical, seamless can body (20), the cylindrical, seamless can body (20) is without any inward protruding portion on cylindrical side thereof except in region where the base (14) and the cylindrical, seamless can body (20) seamlessly integrate, in the method a cylindrical ring (18) is shaped into a top end ring (22), the method includes producing a cylindrical, seamless can body blank (10), that is without any outward protruding portion on cylindrical side thereof, and that is without any inward protruding portion on cylindrical side thereof except in region where the base (14) and the cylindrical, seamless can body blank (10) seamlessly integrate, trimming the opening edge (11) of the can body blank (10), and separating the cylindrical ring (18) from the can body blank (10), the height of the can body blank (10)

being preset in such a way that the can body (20) is formed during separation of the cylindrical ring (18).

6. The method according to claim 5, wherein the cylindrical ring (18) is shaped into a top end ring (22) comprising a flange (24) for fixing to the opening edge (21) of the can body (20) and comprising an annular face (26) lying in the top end plane for fastening the sealing diaphragm (32).

7. The method according to claim 2, wherein the cylindrical ring (18) is separated from the can body blank (10) prior to the complete forming of the can body blank (10).

8. A method for producing a cylindrical, seamless can body (20), that is without any outward protruding portion on cylindrical side thereof, with a preset height and a top end ring (22) made of metal, wherein the top end ring (22) which can be connected to the opening edge of a can body borders a removal opening (30) and a sealing diaphragm (32) covering the removal opening (30) can be attached to the top end ring (22) to form a can top end (38), a base (14) is seamlessly integral with the cylindrical, seamless can body (20), the cylindrical, seamless can body (20) is without any inward protruding portion on cylindrical side thereof except in region where the base (14) and the cylindrical, seamless can body seamlessly integrate, the method producing a cylindrical seamless can body blank (10), that is without any outward protruding portion on cylindrical side thereof, and that is without any inward protruding portion on cylindrical side thereof except in region where the base (14) and the cylindrical, seamless can body blank (10) seamlessly integrate, in a plurality of drawing steps, into the can body (20) with the preset height, trimming of the opening edge 11 of the can body blank (10), separating a cylindrical ring (18) from the can body (10), and shaping the cylindrical ring (18) into the top end ring (22) with a flange (24) for fixing on the opening edge of a can body and comprising an annular face (26) lying in the top end plane for fastening the sealing diaphragm (32).

* * * * *